United States Patent [19]

Stahl

[11] 4,403,622

[45] Sep. 13, 1983

[54] DEVICE FOR USE IN STRAIGHTENING OR RELAXING HAIR, AND METHOD THEREFOR

[76] Inventor: Michael L. Stahl, 7700 SW. 135th Ave., Miami, Fla. 33183

[21] Appl. No.: 402,790

[22] Filed: Jul. 28, 1982

[51] Int. Cl.[3] ..... A45D 2/18

[52] U.S. Cl. ..... 132/43 R; 132/9; 132/7

[58] Field of Search ..... 132/43 R, 43 A, 39, 132/9, 7, 36

[56] References Cited

U.S. PATENT DOCUMENTS

| | | | |
|---|---|---|---|
| 1,951,658 | 3/1934 | Humphrey | 132/43 A |
| 2,524,266 | 10/1950 | Lacastro | 132/43 R |
| 2,760,499 | 8/1956 | Taylor | 132/43 R |
| 2,838,054 | 6/1958 | Fischer | 132/43 R |
| 4,258,733 | 3/1981 | Fulgoni | 132/43 A |

*Primary Examiner*—Gregory E. McNeill
*Attorney, Agent, or Firm*—Meredith P. Sparks

[57] ABSTRACT

This invention relates to a device for use in straightening or relaxing overly-curly or wavy, unmanageable hair, using caustic compositions which can irritate the scalp or skin if brought into contact therewith. The device includes a planar base member or board, adjustable for head size and hair length, with means for covering with paper or similar material which overlaps the top edge of the board. The board covered with the paper is placed next to the scalp and the hair overlaps the board and paper at the top edge. The paper is cut off at a distance from the length of a lock of hair placed thereupon. The relaxing composition is then applied to the lock of hair and worked into the hair for suitable time, as determined by the operator. The board is then removed and the process repeated for another lock of hair.

9 Claims, 3 Drawing Figures

DEVICE FOR USE IN STRAIGHTENING OR RELAXING HAIR, AND METHOD THEREFOR

BACKGROUND OF THE PRESENT INVENTION

Several million people in the United States, as well as abroad, Black, Latin and Caucasian, have overcurly or wavy unmanageable hair. To overcome this unwanted characteristic the excess curl or wave is relaxed or straightened by treatment with certain strongly alkaline lotions, creams or gels, all of which are corrosive, and capable of irritating the scalp or skin during the time required for treatment unless kept separated therefrom during the process of treatment.

Temporary alteration of the curliness or wave of the hair can be achieved with water and the use of rollers, pincurls or blow waving. After the hair is dry, the new shape will hold. However, once the hair is wet again, it will return to its original curly or wavy shape. The only way to create a permanent change in hair curliness or excessive wave pattern is to treat the hair with fluids in the form of lotions, gels or creams which contain chemicals that are strongly alkaline, and to work the hair by smoothing out the hair with firm pressure while wetted with these chemicals. Hair which has been relaxed or straightened in this manner can then be subjected to wet-set styling. The straightening process is often repeated three or four times during the course of a year.

The relaxing fluid must be carefully applied so as not to overprocess the hair. However, premature removal of the relaxing composition will fail to cause a permanent change. No base relaxing methods now employed treat the hair directly with the corrosive chemical composition by combining onto the hair without protecting the scalp, with the result that patrons with sensitive scalps, or with inexperienced operators, often have considerable discomfort or pain during the treatment, and in addition the patrons may have chemical burns due to the action of the strong alkali on the scalp, or around the ears and face. Chemical burns due to strong alkali produce necrosis which may extend slowly for several hours. These burns may later blister or scab over and become unsightly, as well as resulting in a more serious injury. The extent of injury corresponds to the duration of treatment required for each particular individual, and intensity of action.

The present invention relates to a device for use in relaxing and straightening overly-curly or wavy hair, and a method for use of this device. The device enables the hair to be "worked" with the relaxing cream on a board, with paper placed under the lock of hair in such a manner that the cream does not reach the scalp during "working". Thus the patron avoids discomfort and burns.

DETAILED DESCRIPTION OF A PREFERRED EMBODIMENT

Figure 1:
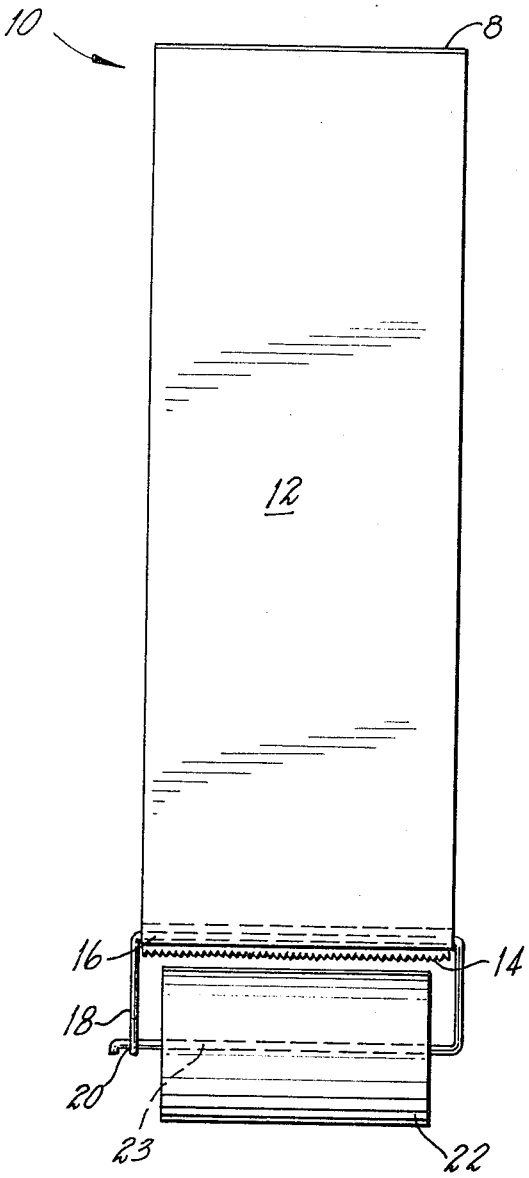
FIG. 1 is a perspective view of the base member or board, in assembly with the roll of paper and paper-cutting means in linear position.

With reference to the drawings, in which like reference characters designate like or corresponding parts throughout the various views, and particular reference to FIG. 1, the device for use in straightening or relaxing hair of the present invention, is designated generally at 10 and includes a rectangular base member or board preferably having a serrated cutting edge 14, and a hinge 16 for holding a rectangular shaped wire member 18, one side of which is hinged along the width of the base member 12. The other side of the wire member 18 serves as a spindle 23 for holding a roll of paper 22. The wire member 18, together with the roll of paper 22 mounted thereupon can be raised or lowered so that when the paper is unrolled it can be brought in contact with the serrated cutting edge 14 of board 12 for cutting off a length of paper, as described hereafter. The serrated cutting edge can be a part of the molded board, or separately attached thereto. It can be eliminated, if desired, in which event the cutting is done with a razor blade or scissors.

The wire member 18 has a wire fastener 20 at one end which can be opened or closed for inserting or removing the roll of paper. The paper on the roll has a width less than the width of the base member or board 12. It is an advantage of this invention that readily available rolls of paper, for example, rolls sold for use with business machines such as adding machines, are satisfactory for the purposes. Using a board size 4"×12", adding machine paper is commercially available having a width of about 4". The board size may be varied according to the amount of hair to be treated at one time, and its length.

The fastener is made of wire bent to secure the roll. Other means of holding the roll in place and opening and closing the holder for inserting or removing the roll can be substituted for the wire holder, as is known in the art. The paper is generally somewhat absorbent of the hair straightening composition C and a lock of hair L wetted with the composition tends to adhere to the paper after treatment of hair with the composition C.

The top edge 8 of board 12 may be curved slightly to fit the contour of a head against which it is placed. The board 12 is preferably made of plastic. It can also be made of cardboard, jacketed with a material which is impervious to the hair straightening composition C..

The board 12 can consist of two or more parts which slide into one another in order to make the total length of the board adjustable to the length of the lock of hair L, and compact in size for storing or travel. The length of the board is determined somewhat by the length of the lock of hair to be treated. The width is generally from 2" to 4", to accomodate the lock of hair for treatment.

Figure 2:
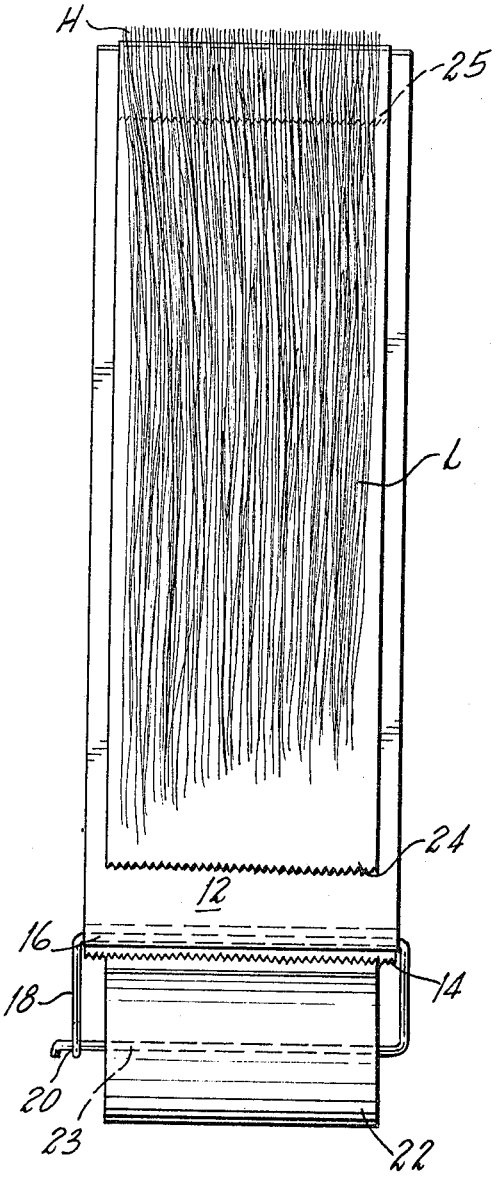
FIG. 2 is a top plan view of a fragmentary portion of one end of the device of the present invention disposed in place on a head with a lock of hair positioned thereon, and the paper cut off just below the length of the lock of hair.
Figure 3:
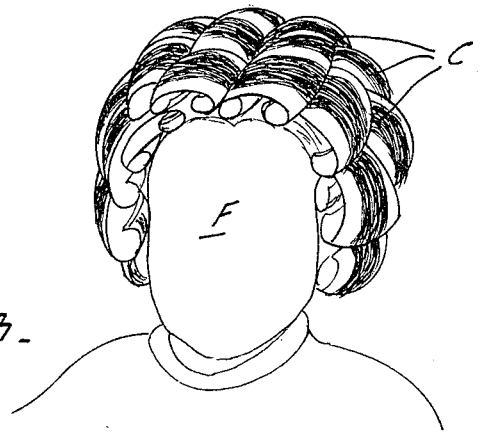
FIG. 3 is a view illustrating the front portion of a completed head, with the papers and treated hair arranged according to the process of this invention around face F.

In FIG. 2 a strip of paper 24 has been drawn from roll 22 and folded over the top edge 8 of board 12 for about ½" to 1½" as shown at 25. The assembly is then positioned against the hair H on a head, and a lock of hair L is combed or drawn over the top edge 8 of the board 12. The strip of paper 24 is then cut off about 2" beyond the end of the lock of hair L. Conveniently this is done by tearing against the serrated edge of the board. However, a razor blade or scissors may be used for cutting.

The terms "hair relaxing" and "relaxer" or "relaxer formula" are used in the same sense as in the trade of professional haircare, to mean the modification of wavy, curly, or kinky hair to become more like "straight" hair, and the means therefor. These terms are defined and explained more completely in the trade literature.

The relaxer is a composition C or formula in the form of a lotion, cream or gel which is strongly alkaline, usually containing sodium hydroxide (lye). Of course, other strongly alkaline chemicals, such as potassium hydroxide, or strong organic bases may be substituted for part or all of the lye in the commercial formula. These compositions must be handled with great care and skill to avoid skin and scalp irritation, hair breakage and eye injury. Gloves are recommended for the operator.

Textiles or synthetic materials can be substituted for paper. Various grades of paper are acceptable for this use.

The method of this invention includes the following steps:

1. Section off locks of hair on the head which are to be straightened or relaxed.

2. Unroll paper onto board for the full length of the board and fold paper over the top edge of the board for a width of about ½" to 1½".

3. Hold board with paper overlay under a lock of sectioned hair to be straightened, keeping the board firmly against the scalp, with only the paper touching the scalp.

4. While holding a lock of hair in place on the board, apply the relaxing composition to the base of the hair shaft, being careful not to let the relaxing composition flow onto the scalp.

5. Work the composition onto the hair, for example, by smoothing with the fingers or a comb.

6. Cut off the bottom edge of the paper from the roll about 2" beyond the end of the lock of hair being treated, using the serrated edge of the board, or with a razor blade or scissors.

7. When working is sufficient, and paper is cut, with a gentle motion slide the board out from the lock of hair, leaving the paper sticking to the hair.

7. Repeat steps 2–7 with another lock of hair. It is generally preferred to start at nape of neck or where hair is curliest and work up. For good results the hair is parted at the top of the head and divided into rows and sections. When one row is finished, proceed around the head with adjacent rows. The operator will allow about 5 to 25 minutes for treatment depending on the type of hair and the amount of straightening desired. The manufacturer's instructions are used as a guide.

8. When processing time is over, take patron to sink, remove paper from back of head, rest patron's head in the sink, and then remove paper from top and sides of head. Then shampoo.

During the treatment, since no two heads of hair are alike, the operator watches the hair to determine the treating time required to achieve the desired amount of straightening.

While certain representative embodiments and details have been shown for the purpose of illustrating the invention, it will be apparent to those skilled in the art that various changes and modifications may be made therein without departing from the spirit and scope of the invention

I claim:

1. A device for use in straightening and relaxing hair comprising a generally flat base member or board of a predetermined length and width, including a first and second end portions, and opposed longitudinal side edge portions, the first end portion to rest next to the head of hair to be treated; and the second end portion, having along the width of said board a cutting edge, and a means for holding a generally rectangular shaped wire member; said wire member having one length approximately the same as the width of said base member, and with said length of said wire member being held along said width of said base member;

having a second length which serves as a means for holding a roll of paper; and along one width of said wire member having a fastener capable of being open and closed for inserting or removing said roll of paper;

whereby said means for holding said wire member can act as a hinge for lowering or raising the assembly of wire member and roll of paper to bring a strip of paper, unrolled from a roll, in contact with said cutting edge of said base member in order to cut a length of paper having a desired length.

2. The device of claim 1 wherein said board is made of plastic.

3. The device of claim 1 wherein said board is made of cardboard jacketed with material impervious to corrosion by strongly alkaline compositions.

4. The device of claim 1 wherein said first end portion has a slight curvature to conform to the head against which it is to rest.

5. The device of claim 1 wherein said board consists of more than one segment which slides into one another so that the board is adjustable for length.

6. A process for straightening or relaxing overly curly or wavy hair using conventional compositions which comprises the steps of:

a. separating a discrete lock of hair from the remainder of the hair on a person's head;

b. unrolling the paper on the roll of the device of claim 1 onto said board for the full length of the board and folding the paper over the top edge of the board for a distance of about ½" to 1½";

c. Positing said board with paper overlay under said lock of hair to be straightened, keeping the board firmly against the scalp, with only the paper touching the scalp;

d. While holding said lock of hair in place on the board, applying a relaxing composition to the base of the hair shaft, being careful not to let the relaxing composition flow onto the scalp;

e. Working the composition onto the lock of hair by smoothing with fingers or a comb;

f. Cutting off the bottom edge of the paper from the roll; and sliding the board out from the lock of hair;

g. When treatment is sufficient to reduce curliness to the desired amount, removing paper and shampooing hair.

7. The process of claim 6 in which the treating time is from about 5 to about 25 minutes.

8. The process of claim 6 which is applied in sequence to more than one lock of hair.

9. The process of claim 8 which is applied first to a lock of hair at the nape of the neck, and then to upper locks.

* * * * *